US007419445B2

(12) United States Patent
Nye et al.

(10) Patent No.: US 7,419,445 B2
(45) **Date of Patent: *Sep. 2, 2008**

(54) BASKETBALL BACKBOARD

(75) Inventors: S. Curtis Nye, Clinton, UT (US); Robert A. Astle, Farmington, UT (US)

(73) Assignee: Lifetime Products, Inc., Clearfield, UT (US)

( * ) Notice: Subject to any disclaimer, the term of this patent is extended or adjusted under 35 U.S.C. 154(b) by 3 days.

This patent is subject to a terminal disclaimer.

(21) Appl. No.: 11/441,470

(22) Filed: May 26, 2006

(65) Prior Publication Data

US 2006/0264276 A1 Nov. 23, 2006

Related U.S. Application Data

(63) Continuation of application No. 10/722,664, filed on Nov. 25, 2003, now Pat. No. 7,052,418.

(60) Provisional application No. 60/429,258, filed on Nov. 26, 2002.

(51) Int. Cl.
*A63B 63/08* (2006.01)

(52) U.S. Cl. ..... 473/481; D21/703

(58) Field of Classification Search ..... 473/481, 473/482, 483, 484, 485; D21/703
See application file for complete search history.

(56) References Cited

U.S. PATENT DOCUMENTS 3,233,897 A 2/1966 Sheets
3,603,588 A 9/1971 Ebstein
3,788,642 A 1/1974 Matras et al.
3,964,743 A 6/1976 Salsich, Sr.
4,285,518 A 8/1981 Pearo
4,320,896 A 3/1982 Engle et al.
4,372,555 A 2/1983 Sorensen
4,424,968 A 1/1984 Smith
4,478,415 A 10/1984 Schaffer et al.
4,588,188 A * 5/1986 Mahoney et al. ..... 473/481
4,826,162 A 5/1989 Allen
5,120,054 A 6/1992 Wetzel
5,346,207 A 9/1994 Heinen
5,507,484 A 4/1996 Van Nimwegen
5,597,158 A 1/1997 Spikes
5,722,902 A 3/1998 Dupree
5,827,136 A 10/1998 Halter et al.
5,839,982 A 11/1998 Hying et al.
5,916,047 A 6/1999 Schickert et al.
5,980,400 A 11/1999 Schickert
5,980,401 A 11/1999 Erlewine
6,004,231 A * 12/1999 Schickert et al. ..... 473/481

(Continued)

*Primary Examiner*—Gene Kim
*Assistant Examiner*—M Chambers
(74) *Attorney, Agent, or Firm*—Workman Nydegger

(57) ABSTRACT

A basketball backboard may include one or more weights disposed proximate the perimeter of the backboard in order to enhance the rebounding characteristics of the backboard. In particular, a first weight may be positioned proximate a first side of the backboard and a second weight may be positioned proximate a second side of the backboard in order to enhance the rebounding characteristics of the backboard. Advantageously, the weights may be positioned internally within the backboard or the weights may be positioned externally to the backboard. In addition, the weights may be selectively or permanently attached to the backboard, and the weights may also be sized and configured to increase the rigidity of the basketball backboard.

22 Claims, 5 Drawing Sheets

U.S. PATENT DOCUMENTS

| | | | | |
|---|---|---|---|---|
| 6,186,911 | B1 | 2/2001 | Manthey | |
| D445,857 | S | 7/2001 | Schickert et al. | |
| 6,367,948 | B2 | 4/2002 | Branson | |
| 6,758,768 | B2 | 7/2004 | Spencer | |
| 7,001,290 | B2 | 2/2006 | Mower et al. | |
| 7,052,418 | B2 * | 5/2006 | Nye et al. | 473/481 |
| 7,160,215 | B2 | 1/2007 | Mower | |

* cited by examiner

BASKETBALL BACKBOARD

CROSS-REFERENCE TO RELATED APPLICATIONS

This application is a continuation of U.S. patent application Ser. No. 10/722,664, which was filed on Nov. 25, 2003, now U.S. Pat. No. 7,052,418, which claims priority to and the benefit of U.S. Provisional Patent Application Ser. No. 60/429,258, entitled Basketball Backboard, which was filed on Nov. 26, 2002, which are incorporated by reference in their entireties.

BACKGROUND OF THE INVENTION

1. Field of the Invention

The present invention generally relates to basketball backboards and, in particular, to basketball backboards that provide improved rebounding characteristics.

2. Description of Related Art

Basketball is well known sport that is frequently played in the United States and in many countries throughout the world. In order to play a game of basketball, a basketball backboard and rim or hoop is required. The rim is typically positioned ten feet above a playing surface and the backboard is generally placed slightly behind and above the rim. The rim and backboard are typically held in a stationary position by a support pole. The support pole, backboard and rim may form part of a permanent system that is frequently used in dedicated basketball facilities such as a gymnasium or basketball court. The support pole, backboard and rim may also form part of a portable basketball system that can be moved from one location to another. These portable basketball systems are often used at individual homes or in multi-purpose facilities where it is not desired to install a permanent basketball system.

Basketball backboards used in connection with permanent or portable basketball systems are frequently constructed from solid materials such as wood or metal. Basketball backboards constructed from wood or metal, however, are often relatively heavy and expensive. In addition, basketball backboards constructed from wood or metal often deteriorate over time, especially when used in outdoor environments because the backboards are constantly exposed to harsh weather environments such as rain and snow.

It is also known to construct basketball backboards from injection molded plastic. Injection molded plastic backboards, however, are often excessively flexible and that causes poor rebounding characteristics. In particular, when a basketball strikes the injection molded plastic backboard, the backboard will flex or bend. The amount that the injection molded plastic backboard flexes or bends, however, is often dependent upon which portion of the backboard that the basketball strikes. For example, if the basketball strikes one portion of the injection molded plastic backboard, then the backboard may bend or flex a relatively small amount. On the other hand, if the basketball strikes another portion of the injection molded plastic backboard, then the backboard may bend or flex a much larger amount. The flexing and bending of the backboard different amounts causes the basketball to rebound at different angles and velocities. Accordingly, the basketball does not bounce or rebound from the backboard in a consistent manner, which is very undesirable when playing basketball. In contrast, the basketball should rebound or bounce off the backboard in a consistent and reliable manner regardless of which portion of the backboard that the basketball strikes.

The rebounding performance of conventional injection molded plastic backboards is especially poor for portions of the backboard that are not near the support structure or support pole. For example, only the center portion of a conventional backboard is often connected to the support structure or support pole. Because the center portion of the backboard is supported by the support structure, this portion of the backboard typically flexes or moves a relatively small amount. The outer edges of the backboard and other portions furthest from the support pole are typically not well supported and these portions of the backboard tend to flex or move the most. Thus, the basketball will rebound one way when it strikes near the center portion of the backboard and proximate the support pole, and in another way when it strikes near an outer edge of the backboard and away from the support pole. Therefore, conventional injection molded plastic backboards often have unpredictable and undesirable rebounding characteristics.

It is also known to construct basketball backboards using a structural foam material with an internal cellular structure and a hard external shell to increase the rigidity of the backboard. This type of backboard, however, requires a multiple step manufacturing process that increases the time and cost to manufacture the backboard. Additionally, the internal cellular structure may breakdown over time and it may detach from the external shell after extended use. Because different portions of the backboard may be supported differently, this often creates a backboard with undesirable rebounding characteristics.

Conventional basketball backboards are also constructed from fiberglass. Fiberglass is a relatively inexpensive material that is easy to construct into the desired shape. In addition, fiberglass is a lightweight material that is generally weather-resistant. Unfortunately, fiberglass is not sufficiently impact-resistant to withstand prolonged and vigorous use as a basketball backboard.

It is also known to use acrylic and graphite materials to construct basketball backboards that are lightweight and weather-resistant. Lightweight basketball backboards are especially desirable for use with portable basketball systems because lightweight backboards decrease the weight of the system, which may reduce shipping and transportation costs. In addition, lightweight basketball backboards are often easier to move and assemble. Further, lightweight backboards may allow lighter weight and/or less complex support poles or support structures be used to hold the backboard above the playing surface.

These known lightweight basketball backboards, however, may not provide suitable rebounding characteristics because the backboards may undesirably flex, move or otherwise deflect when struck by the basketball. As discussed above, the basketball may rebound with less force or energy because of the flexing or moving of the basketball backboard. In addition, the amount that these known lightweight basketball backboards flex or move is often dependent upon which portion of the backboard that the basketball strikes. For example, the basketball may rebound with a certain amount of force or energy if it strikes one portion of the backboard, but the basketball may rebound with a different amount of force or energy if it strikes a different portion of the backboard. Further, the basketball may rebound from the backboard at a different angle depending upon which portion of the backboard the basketball strikes. For example, if the basketball strikes near the center of the backboard, which is supported by the support pole, the backboard may deflect or move a relatively small amount and the basketball will rebound at an angle. On the other hand, if the basketball strikes near an outer edge of the backboard and away from the support pole, the backboard may deflect or move a much larger amount and the basketball may rebound at a different angle. Thus, conventional lightweight basketball backboards may cause the basketball to rebound with a different amount of force or energy and at a different angle depending upon where the basketball strikes the backboard.

In order to overcome these problems, it is known to increase the thickness of the basketball backboard. Undesirably, this increases the weight and cost of the backboard. It is also known to fill hollow backboards with a material such as polyurethane foam in order to strengthen the backboard. The polyurethane foam, however, tends to lose adhesion over time and after repeated impacts from basketballs striking the backboard. The polyurethane foam also adds significantly to the cost of the backboard because additional materials and manufacturing steps are required.

It is also known to construct basketball backboards from tempered glass. Tempered glass basketball backboards are often used in professional and collegiate games to allow spectators to view the game through the backboard. Tempered glass backboards are generally one-half (½) to three-eights (⅜) of an inch thick and the tempered glass is very heavy. These very heavy backboards require large support frames and support structures to hold the backboards above the playing surface. Tempered glass backboards are generally not suitable for use with portable or home basketball systems because of their large weight and the tempered glass is often prohibitively expensive.

In order to create a look similar to the tempered glass backboards used in professional and college games, transparent or clear backboards are now being used in connection with portable or home basketball systems. For example, conventional portable basketball systems may use a welded steel frame with a planar acrylic rebound member or panel attached to the front surface of the frame. Disadvantageously, the outer edges of the acrylic panel are often exposed and not supported by the metal frame. This allows the edges of the acrylic panel to be broken or damaged when struck by a basketball or other object, and the acrylic panel is generally very difficult and expensive to fix or replace.

It is also known to use an injection molded plastic frame to support the acrylic rebound member or panel. Conventional injection molded plastic frames may include separately molded front and rear sections that are connected to form the frame. In particular, the front and rear sections of the frame may include alignment features that allow the sections to be attached in the desired manner and a slot or opening may be disposed between the front and rear sections of the frame. A substantially planar rebound member constructed from molded plastic may be inserted into the slot to form the basketball backboard. Disadvantageously, the two-piece, injection molded plastic frame is relatively heavy, which increases shipping costs and makes the assembly process more difficult. The two-piece injection molded plastic frame also requires a significant amount of labor to attach the front and rear sections of the frame and insert the rebound member into the slot between the sections.

While conventional basketball backboards constructed with injection molded plastic frames and acrylic rebound members or panels may allow relatively lightweight backboards to be constructed, these types of backboards may not provide suitable rebounding characteristics because the backboards may undesirably flex or move when struck by the basketball. Thus, as described above, a basketball may rebound with different amounts of energy or force and at different angles depending upon which portion of the backboard that the basketball strikes.

BRIEF SUMMARY OF THE INVENTION

A need therefore exists for a basketball backboard that eliminates the above-described disadvantages and problems.

One aspect of the present invention is a basketball backboard with mass or weight added to desired portions of the backboard in order to enhance the rebounding characteristics of the backboard. The additional weight may enhance the rebounding characteristics of the backboard because the basketball may rebound in a more uniform and consistent manner. In particular, the extra weight may help prevent the backboard from undesirably moving and/or deflecting when the basketball strikes the backboard and that may cause the basketball to rebound in a more reliable and dependable fashion. Advantageously, the additional mass or weight may be selectively or permanently attached to the backboard.

Another aspect is a basketball backboard with additional mass or weight added to the perimeter or outer portions of the backboard. In particular, mass or weight may be added to the edges or other desired portions of the backboard to create an at least partially perimeter-weighted backboard. In addition, the added mass or weight may be positioned away from the structure that is used to support the basketball backboard. Desirably, the added mass or weight is positioned near the perimeter of the backboard and away from the support structure, but the positioning of the added mass or weight may depend, for example, upon the shape and configuration of the backboard and/or support structure. Advantageously, the additional mass or weight may create a more uniform and predictable rebounding of the basketball because the additional weight may help prevent the backboard from undesirably moving and/or deflecting when struck by a basketball.

Yet another aspect is a basketball backboard in which mass or weight may be added to the backboard after shipping and/or transport of the backboard. For example, the basketball backboard may include one or more openings that allow materials such as sand, water, metal bars or other materials to be attached to the backboard by the user. On the other hand, one or more weights may be attached to outer or exterior portions of the basketball backboard. Significantly, this allows a lightweight backboard to be shipped to a user and the user can then add weight to desired portions of the backboard by simply filling one or more openings with sand or water, or connecting one or more weights to selected portions of the backboard.

Still another aspect is a basketball backboard in which additional mass or weight can be added to one or more interior portions of the backboard. For example, additional mass or weight may be integrally formed in the backboard during the construction process. On the other hand, additional mass or weight may be added to an interior portion of the backboard after the backboard has been constructed. Advantageously, because the additional mass or weight may be at least partially enclosed within the backboard, the appearance, design or aesthetics of the mass or weight may not be an important consideration.

A further aspect is a basketball backboard in which mass or weight can be added to an exterior portion of the backboard. For example, one or more sleeves or other members may be attached to exterior portions of the basketball backboard to add mass or weight to desired portions of the backboard. The external weights may be attached to the backboard by screws, bolts, fasteners, adhesives, etc., or by a friction, snap or interference fit. The external weights are preferably at least partially exposed and these external weights may be connected before, during or after the manufacturing process. Because at least a portion of the additional mass or weight is exposed, the backboard may be specifically designed to receive this additional mass or weight, and the additional mass or weight may form part of the design or appearance of the backboard.

Yet another aspect is a basketball backboard with a strengthening member that may be used to increase the rigidity of the backboard. For example, a strengthening member may be attached to a rear surface of the backboard and it may extend from one side of the backboard to an opposing side. In addition, two or more strengthening members may also be used to increase the rigidity or stiffness of the backboard. The strengthening members may also be positioned to selectively add mass or weight to desired portions of the basketball backboard. For example, one or more strengthening members may be generally vertically positioned and the strengthening members may be disposed proximate opposing ends of the backboard.

Still another aspect is a basketball backboard with a reinforcement structure that may be used to increase the rigidity of the backboard and/or add mass to selected portions of the backboard. The reinforcement structure is desirably positioned about the perimeter of the basketball backboard and the reinforcement structure may be constructed from materials such as metal. The reinforcement structure could also be sized and configured to add mass or weight to desired portions of the basketball backboard.

Another aspect is a basketball backboard that is at least partially constructed from plastic. Preferably, all or at least a portion of the basketball backboard is constructed from blow-molded plastic, but the backboard could also be constructed using other suitable methods and processes such as injection molding, extrusion molding, compression molding, and the like. All or a portion of the basketball backboard could also be constructed from other suitable materials such as metal, wood, acrylic, Lexan®, and the like.

A further aspect is a basketball backboard that is constructed from one or more pieces. For example, a one-piece backboard could be constructed or the backboard could be constructed from two or more pieces. For example, the backboard could include a support frame that is constructed from blow-molded plastic and a rebound member or panel that is attached to the frame. The rebound member is preferably a planar acrylic sheet, but any suitable rebound member may be used.

Another aspect is a basketball backboard that is at least partially constructed from generally lightweight materials, such blow-molded plastic. Advantageously, a lightweight basketball backboard can be easily transported and shipped. The lightweight backboard also allows a lightweight basketball goal system to be easily constructed and assembled. In addition, the lightweight backboard does not require a large support structure to hold the backboard above the playing surface.

Another aspect is a basketball backboard at least partially constructed from blow-molded plastic and the blow-molded plastic includes one or more depressions, "tack-offs" or "kiss-offs." The depressions may be formed in the backboard and/or the backboard frame, and the depressions are desirably sized and configured to increase the strength and rigidity of the backboard. The depressions preferably extend from one surface and contact or engage an opposing surface, but the depressions do not have to contact or engage the opposing surface. The depressions are desirably formed in the back or rear surface of the basketball backboard and/or frame so that the depressions are generally not visible while playing the game of basketball. The depressions, however, may also be formed in the front surface of the basketball backboard and/or frame. In addition, one or more depressions may be formed in the rear surface of the frame and one or more depressions may be formed in the front surface of the frame, and these opposing depressions may be generally aligned. At least a portion of these opposing depressions preferably contract or engage each other, but the opposing depressions do not have touch or engage. Further, one or more depressions may be located on one surface of the frame or backboard and one or more depressions may be located in an opposing surface of the frame or backboard.

Advantageously, a basketball backboard at least partially constructed from blow-molded plastic is relatively strong because it includes two or more opposing walls or surfaces that are separated by a given distance. The opposing walls help create a high-strength, rigid basketball backboard and the backboard may be relatively lightweight because the interior portion of the backboard between the opposing walls may be hollow. Significantly, the strong and sturdy basketball backboard can withstand repeated impacts with a basketball or other similar objects.

Significantly, a basketball backboard at least partially constructed from blow-molded plastic can be quickly and easily manufactured. In particular, the blow-molding process allows the double walls and one or more depressions to be quickly and easily formed. As discussed above, the double walls and depressions allow a strong and sturdy backboard to be constructed. These and other features also allow the basketball backboard to be constructed with relatively thin plastic walls and that reduces the amount of materials required to construct the backboard. This also reduces the weight of the backboard, which saves manufacturing costs and decreases the amount of resources used to construct the backboard. The thin walls also allow the backboard to be cooled more quickly during the manufacturing process, and that saves additional time and further decreases costs.

Another aspect is a basketball backboard with an outer periphery or exterior. This outer periphery, for example, may have a generally rectangular configuration with generally parallel disposed upper and lower surfaces. The outer periphery of the backboard, however, may also be curved or have other desired shapes and configurations. As discussed above, mass or weight may be selectively attached to the outer periphery of the backboard in order to increase the rebound performance of the backboard.

Yet another aspect is a basketball backboard that can be constructed in any desired configuration, shape, size and design depending upon its intended use. Advantageously, because at least a portion of the basketball backboard is preferably constructed from blow-molded plastic, the backboard is durable, weather resistant and generally temperature insensitive.

A further aspect is a basketball goal assembly including a backboard with a front surface, a rear surface, a first side and a second side. A first weight is positioned proximate the first side of the backboard, a second weight positioned proximate the second side of the backboard, and a rim positioned proximate the front surface of the backboard. The first weight and the second weight are sized and configured to enhance the rebounding characteristics of the backboard. The backboard may include a first internal portion and a second internal portion with the first weight at least partially disposed within the first internal portion of the backboard and the second weight at least partially disposed within the second internal portion of the backboard. The backboard may also include a first opening and a second opening with the first weight being at least partially disposed within the first opening and the second weight at least partially disposed within the second opening. In addition, the first weight may generally comprise a first sleeve that is attached to a first edge of the backboard and the second weight may generally comprise a second sleeve that is attached to a second edge of the backboard. Further, at least a portion of the backboard may be constructed from blow-molded plastic. Finally, the first weight and the second weight may be constructed from generally rigid materials that are sized and configured to increase the rigidity of the backboard.

The basketball goal assembly may include a reinforcement structure that is attached to the backboard, at least a portion of the reinforcement structure generally extending from the first side to the second side of the backboard. The basketball goal assembly may also include a reinforcement structure that is generally disposed about the periphery of the backboard. In addition, the basketball goal assembly may include a reinforcement structure that is attached to the backboard, the first weight forming at least a first portion of a reinforcement structure and the second weight forming at least a second portion of the reinforcement structure. Further, the first weight of the basketball goal assembly may be removably connected to the first side of the backboard and the second weight may be removably connected to the second side of the backboard.

A still further aspect is basketball backboard including a support frame with a first side and a second side, a rebound member attached to the support frame, a first weight that is sized and configured to be attached to the first side of the support frame to enhance the rebounding characteristics of the basketball backboard, and a second weight that is sized and configured to be attached to the second side of the support frame to enhance the rebounding characteristics of the basketball backboard.

Another aspect is a basketball goal assembly including a backboard with a front surface and a rear surface, a first weight that is capable of being attached to the perimeter backboard, the first weight being sized and configured to enhance the rebounding performance of the backboard, and a second weight that is capable of being attached to the perimeter backboard, the second weight being sized and configured to enhance the rebounding performance of the backboard.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

The present invention is generally directed towards a basketball backboard for a basketball goal assembly. In order to assist in the description of the basketball backboard, words such as top, bottom, front, rear, right and left are used to describe the accompanying figures. It will be appreciated, however, that the basketball backboard can be located in a variety of desired positions and angles. A detailed description of the basketball backboard of a basketball goal assembly now follows.

Figure 9:
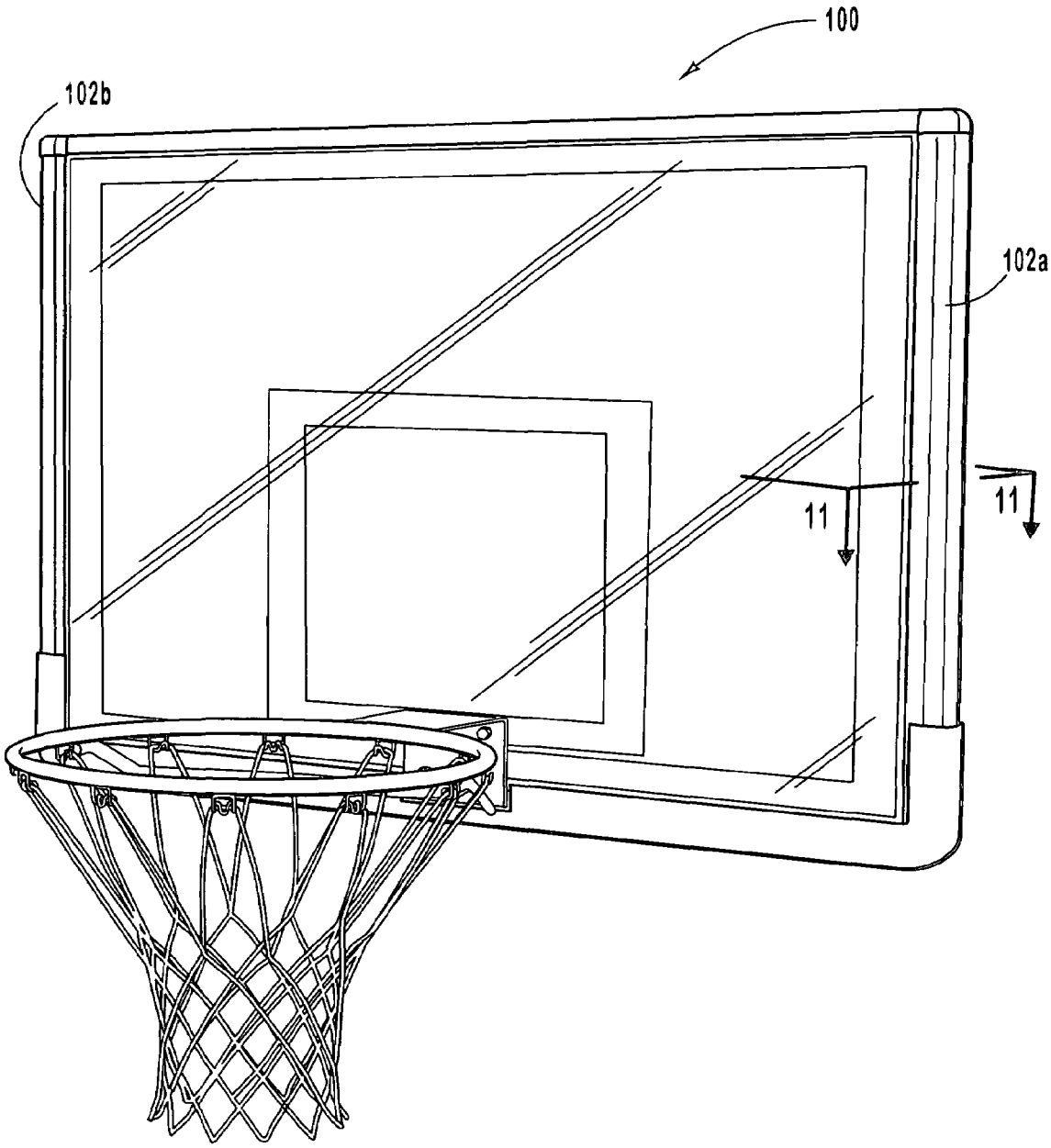
FIG. 9 is a front perspective view of a basketball goal assembly in accordance with still another embodiment of the invention.
Figure 10:
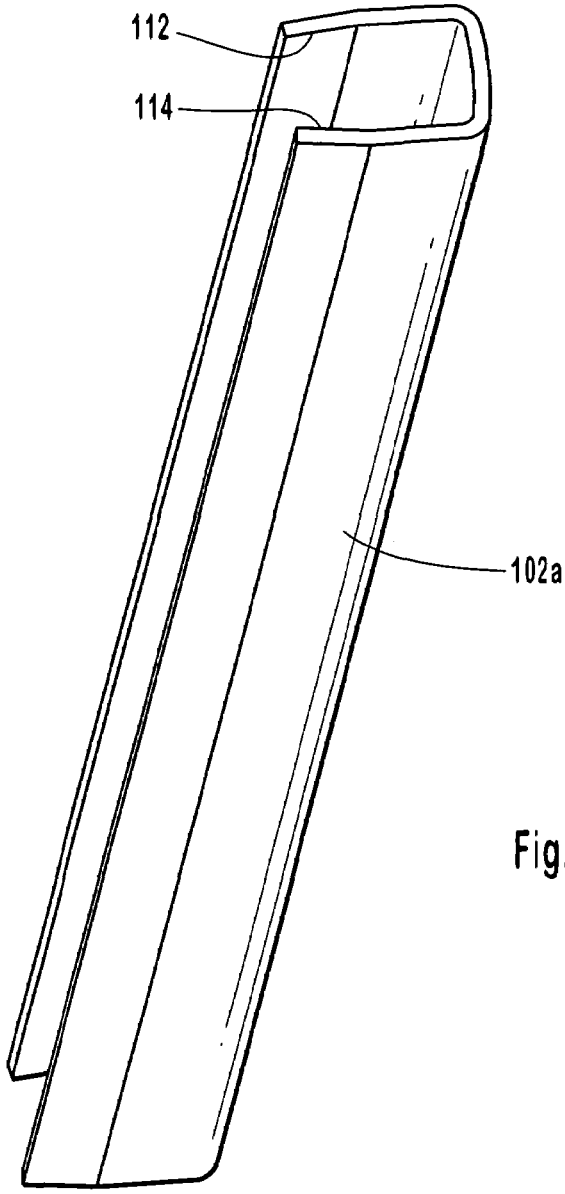
FIG. 10 is an enlarged perspective view of a portion of the basketball goal assembly shown in FIG. 9.
Figure 11:
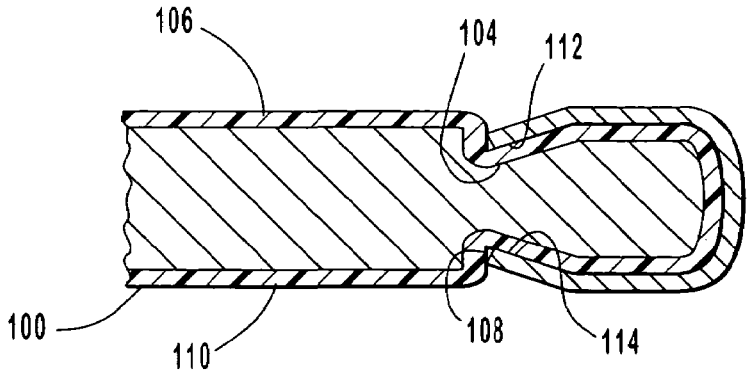
FIG. 11 is a cross-sectional side view along lines 11-11 of a portion of the basketball goal assembly shown in FIG. 9.

The basketball goal assembly 8 generally includes a backboard 10 and a rim or hoop 1. As shown in FIGS. 1-8, an exemplary embodiment of the backboard 10 may be constructed from two or more components that are interconnected. As shown in FIGS. 9-11, another exemplary embodiment of the backboard 10 may also be constructed from a single piece of material or component. The basketball goal assembly 8 may be part of a permanent or portable basketball system that may include, for example, a support structure and a support pole.

Figure 1:
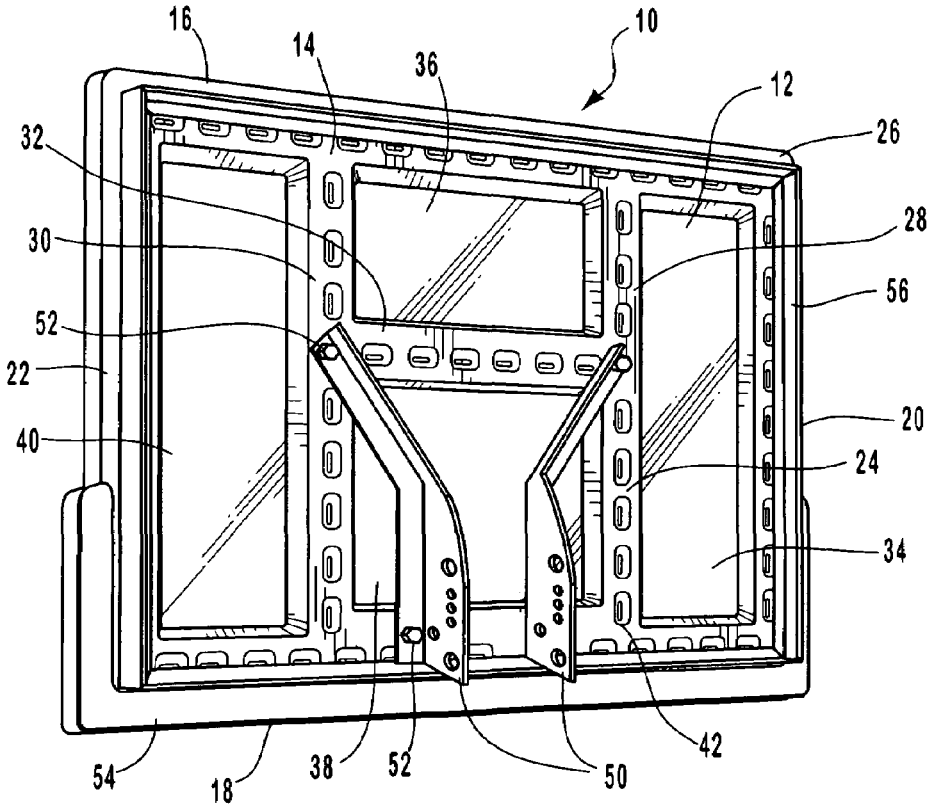
FIG. 1 is a rear perspective view of a basketball goal assembly in accordance with an embodiment of the invention.

In greater detail, as seen in FIG. 1, the backboard 10 may consist of a two-piece backboard with a rebound member or panel 12 and a support frame 14. The rebound member 12 is preferably attached to the front surface of the support frame 14 by an adhesive, such as disclosed in assignee's co-pending U.S. patent application Ser. No. 09/228,325, entitled System and Method for Bonding an Acrylic Surface to a Frame, which was filed on Jan. 11, 1999 and is hereby incorporated by reference in its entirety. It will be appreciated that the rebound member 12 can also be attached to the support frame 14 by one or more screws, bolts, fasteners, adhesives and the like. As discussed in greater detail below, the backboard 10 can also consist of a unitary, one-piece structure or be constructed from a single component or material.

The rebound member 12 preferably has a generally smooth, planar outer surface so that a basketball bounces or rebounds off the rebound member in a consistent manner. The rebound member 12 is preferably constructed from plastic and, more preferably, from an acrylic sheet that has sufficient thickness so that it will not break during an ordinary game of basketball. The rebound member 12 is preferably constructed from an acrylic sheet because it is lightweight, easy to manufacture, and allows the basketball goal assembly 8 to be easily assembled. In addition, the rebound member 12 is preferably constructed from acrylic or other suitable clear, transparent or generally translucent materials so that light can pass through the backboard 10. This creates a backboard 10 that is similar in appearance and characteristics to that used in professional and major college games. One skilled in the art, however, will realize that the rebound member 12 can be constructed from other suitable materials and the rebound member can be constructed from opaque or other types of solid materials.

The support frame 14 is preferably constructed from a lightweight material, such as plastic. Desirably, the support frame 14 is constructed from blow-molded plastic to create a strong, lightweight and durable frame. In greater detail, the support frame 14 is preferably constructed using a blow-molded plastic process, and the frame includes two opposing walls or surfaces that are separated by a given distance in order to create a strong and sturdy structure. In addition, the interior portion of the support frame 14 is preferably generally hollow to create a lightweight structure, but the support frame does not have to be hollow. The support frame 14 is preferably designed to withstand repeated impacts with a basketball or other similar objects. One skilled in the art will appreciate that the support frame 14 can also be constructed using other suitable methods and processes such as injection molding, extrusion molding, compression molding, and the like. In addition, one skilled in the art will appreciate that the support frame 14 can be constructed from other materials with desired characteristics such as metal, wood, acrylic, Lexan®, composites, and the like.

The basketball backboard support frame 14 is preferably constructed from blow-molded plastic because it can easily be formed into any desired size and configuration. The support frame 14 is also desirably constructed from blow-molded plastic because it is durable, weather resistant and generally temperature insensitive. Advantageously, because the basketball backboard support frame 14 can be constructed from blow-molded plastic, it will not corrode, rust or otherwise deteriorate over time.

In addition, as discussed in more detail below, the support frame 14 may allow additional weight or mass to be selectively or permanently attached to enhance the rebounding characteristics of the backboard 10. Because the additional weight or mass may be selectively connected to the support frame 14, the backboard 10 may be shipped to the retailer or consumer without the weight or mass attached to decrease shipping costs. The additional weight or mass can then be added by the retailer or consumer, if desired.

Advantageously, the blow-molded plastic support frame 14 allows multiple features to be formed in the frame. For example, various support and mounting structures may be created in the support frame 14 during the blow-molding process. In particular, one or more holes used to mount a basketball rim or hoop (not shown) to the support frame 14 may be created during the blow-molding process. Thus, a drilling step can be eliminated from the manufacturing process. Forming these and other features formed during the blow-molding process can save time and manufacturing costs. In addition, these features may be integrally formed in the support frame 14 and the features may be simultaneously created during the blow-molding process. Because these features may be simultaneously formed during the blow-molding process, this may save costs because the overall manufacturing cost of a product generally increases with each additional manufacturing step.

The support frame 14 is preferably constructed as a unitary, one-piece structure, which further decreases manufacturing costs and time because one or more components do not have to be assembled or fastened together. In addition, the one-piece structure allows a strong and sturdy support frame 14 to be manufactured. It will be appreciated that the support frame 14, however, may be constructed by one or more components that are fastened together by any suitable means.

As shown in the accompanying figures, the support frame 14 has a generally rectangular outer periphery or exterior with a top surface 16 that is generally parallel to a bottom surface 18, and a left side 20 that is generally parallel to a right side 22 of the frame. It will be appreciated, however, that the outer edges of the support frame 14 do not have to be generally parallel and the frame does not require a generally rectangular configuration. For example, the outer edges of the frame 14 can be curved, rounded, arched, or have any suitable design and configuration depending, for example, upon the intended use of the frame.

The support frame 14 also includes a generally H-shaped support 24 disposed between the outer edges or periphery 26 of the frame. The generally H-shaped support 24 is preferably centrally disposed between the left side 20 and right side 22 of the frame 14, and the support structure includes a first lateral support member 28, a second lateral support member 30 and a horizontal support member 32. One skilled in the art will recognize that the support 24 does not require a generally H-shaped configuration and the support structure can have any suitable size and configuration.

The H-shaped support 24 desirably divides the support frame 14 into four distinctive openings or sections 34, 36, 38 and 40 disposed between the support structure and the periphery 26 of the frame 14. Advantageously, the H-shaped support 24 and the periphery 26 of the frame 14 securely support the rebound member 12. In addition, the large openings 34, 36, 38 and 40 allow a lightweight basketball goal assembly 8 to be created.

The frame 14 may also include other features such as depressions 42 or "tack-offs." The depressions 42, which extend from one surface towards the other surface, are desirably sized and configured to increase the strength and/or rigidity of the support frame 14. Preferably, the depressions 42 extend from one surface and contact or engage an opposing surface, but the depressions do not have to contact or engage the opposing surface. The depressions 42 are desirably formed in the back or rear surface of the support frame 14 so that the depressions are generally not visible while playing the game of basketball. The depressions 42, however, may also be formed in the front surface of the support frame 14. These depressions 42 may be covered in whole or in part by the rebound member 12. In addition, one or more depressions 42 may be formed in the rear surface of the support frame 14 and one or more depressions may be formed in the front surface of the frame, and these opposing depressions may be generally aligned. Desirably, at least a portion of these opposing depressions 42 contract or engage each other, but the opposing depressions do not have touch or engage. One skilled in the art will appreciate that the number, size and location of the depressions 42 may depend upon factors such as the desired strength of the support frame 14.

As shown in the accompanying figures, the depressions 42 preferably have a generally trapezoidal configuration. Advantageously, the trapezoidal configuration provides desirable bearing and torsional characteristics for the basketball goal assembly 8. For example, the trapezoidal shape appears to prevent the support frame 14 from bending or yielding when a basketball rebounds from the backboard 10. Thus, the basketball goal assembly 8 tends to have rebounding characteristics that are similar to larger and heavier backboards. It will be understood, however, that the depressions 42 could have any suitable configurations such as rectangular, oblong, and the like.

Figure 3:
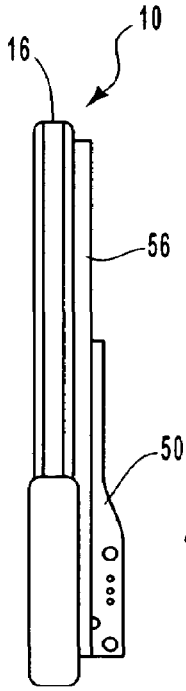
FIG. 3 is a side view of the basketball goal assembly shown in FIG. 1.
Figure 2:
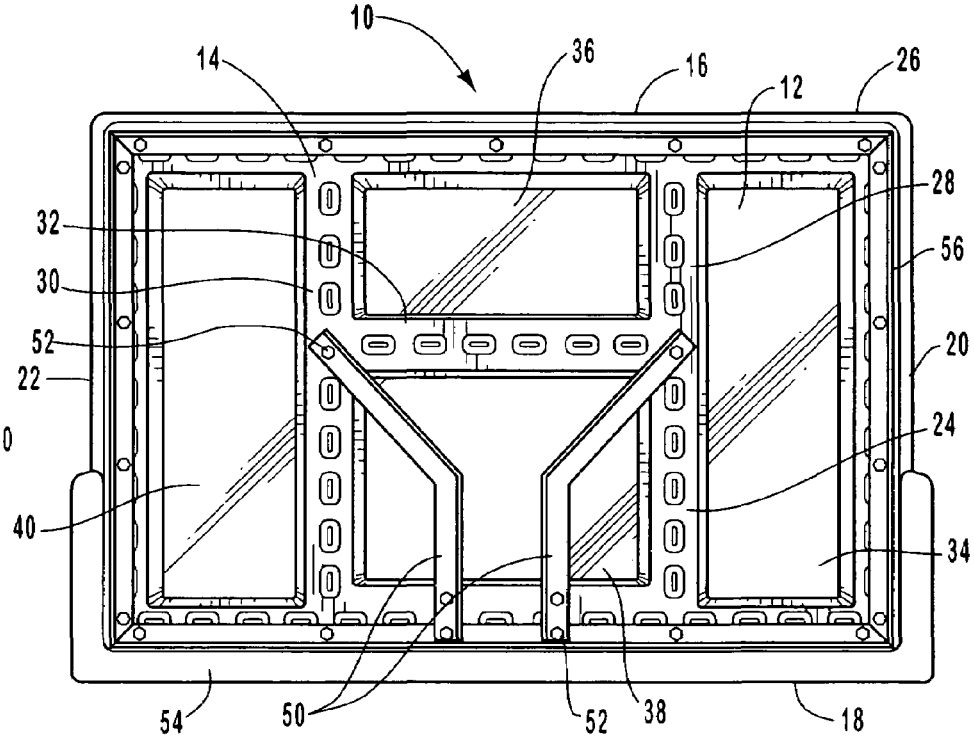
FIG. 2 is a rear view of the basketball goal assembly shown in FIG. 1.

As shown in FIGS. 1-3, a mounting bracket 50 may be attached to the backboard 10. The mounting bracket 50 is preferably attached to the H-shaped support 24 and the periphery 26 of the support frame 14 any suitable fasteners such as bolts or screws, or other materials such glue or tape. The mounting bracket 50, which can have any suitable size and configuration, is used to attach the backboard 10 to a support structure such as a pole (not shown). Accordingly, the mounting bracket 50 may have different shapes and sizes depending, for example, according to the type and configuration of the backboard 10 and/or support structure. One skilled in the art will appreciate that the mounting bracket 50 is not required and the backboard 10 may be directly connected to the support structure.

As shown in the accompanying figures, protective padding or cushioning material 54 may also be attached to the backboard 10 in order to help protect basketball players from injury. The padding 54 is preferably a resilient material that absorbs energy from impacts such as from the hands and arms of players, but the padding is not required as part of the basketball goal assembly 8.

A reinforcement structure 56 may also be attached to the backboard 10. For example, as shown in FIGS. 1-3, the reinforcement structure 56 may be attached to the rear surface of the backboard 10 by any suitable fasteners such as bolts or screws, or other materials such glue or tape. The reinforcement structure 56 is desirably sized and configured to add mass or weight to selected portions of the backboard 10. For example, as shown in FIGS. 1-3, the reinforcement structure 56 is disposed about the periphery 26 of the backboard 10 to increase the mass disposed about the edges of the backboard. Significantly, this extra weight disposed about the perimeter of the backboard 10 helps prevent the backboard from moving or deflecting when a basketball strikes near the outer edges of the backboard. In particular, the additional mass provided by the reinforcement structure 56 may help decrease the undesired movement and/or deflection of the backboard 10 when it is struck by a basketball. Accordingly, the rebounding performance of the backboard 10 may increase because the basketball rebounds in a more predictable manner.

The reinforcement structure 56 may also include portions with a larger or smaller mass in order to create more predictable rebounding of the basketball from the backboard 10. For example, the left and right sides of the reinforcement structure 56 may include additional mass and/or the top and bottom portions of the reinforcement structure may include additional mass. Advantageously, this may help create a perimeter-weighted backboard 10, which may improve rebounding performance. In addition, located the additional mass at the outer edges of the backboard may position the additional mass away from the support structure, which may also improve rebounding performance. One skilled in the art will appreciate that the reinforcement structure 56 may have any suitable size, mass, and configuration depending, for example, upon the desired rebounding characteristics of the backboard 10. Thus, the reinforcement structure 56 does not have to be located proximate the edges or periphery of the backboard 10.

In addition, the reinforcement structure 56 may increase the rigidity of the backboard 10, which may also increase rebounding performance. In particular, the reinforcement structure 56 may be constructed from a relatively stiff, inflexible material, such as metal, plastics, composites, etc., that generally do not bend. Thus, the reinforcement structure 56 may provide additional support to the backboard 10 so that any flexing or bending of the backboard is minimized. Advantageously, the rebounding performance of the backboard 10 may increase because the backboard is a more rigid structure that does not give or deflect when struck by the basketball. If the reinforcement structure 56 is disposed about the periphery of the backboard 10, that may help prevent the outer edges of the backboard from deflecting when struck by the basketball. It will be appreciated, however, that the reinforcement structure 56 may be attached to any suitable portion of the backboard 10 and the reinforcement structure could be constructed from any suitable materials with the appropriate characteristics.

Figure 4:
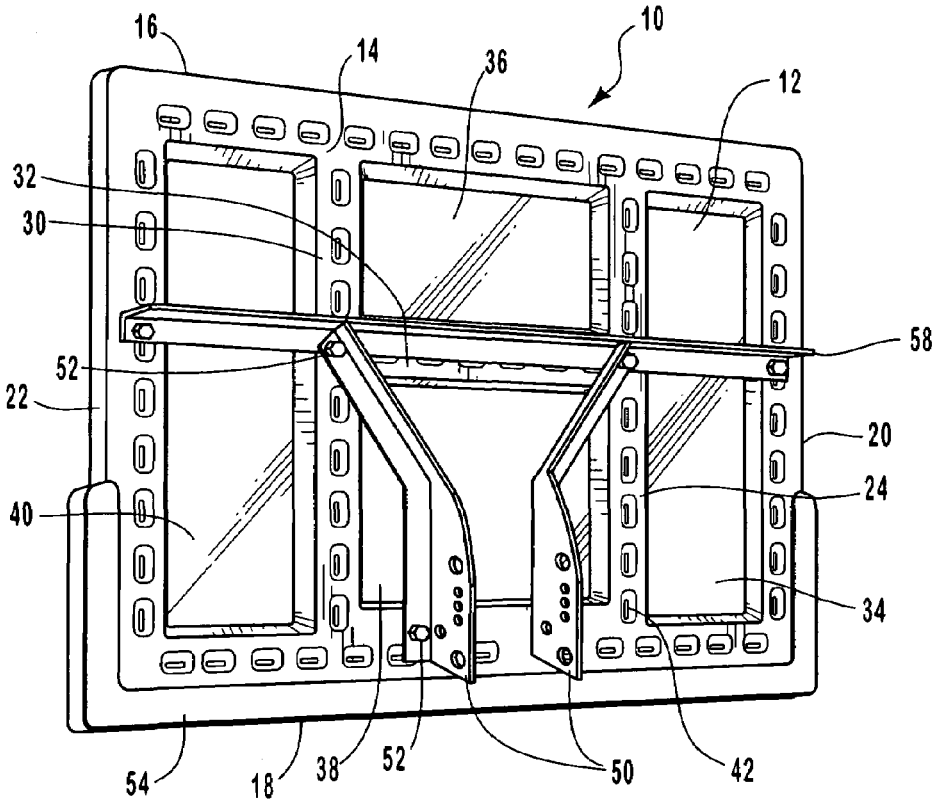
FIG. 4 is a rear perspective view of a basketball goal assembly in accordance with another embodiment of the invention.
Figure 6:
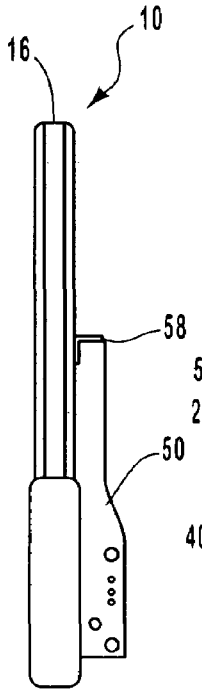
FIG. 6 is a side view of the basketball goal assembly shown in FIG. 4.
Figure 5:
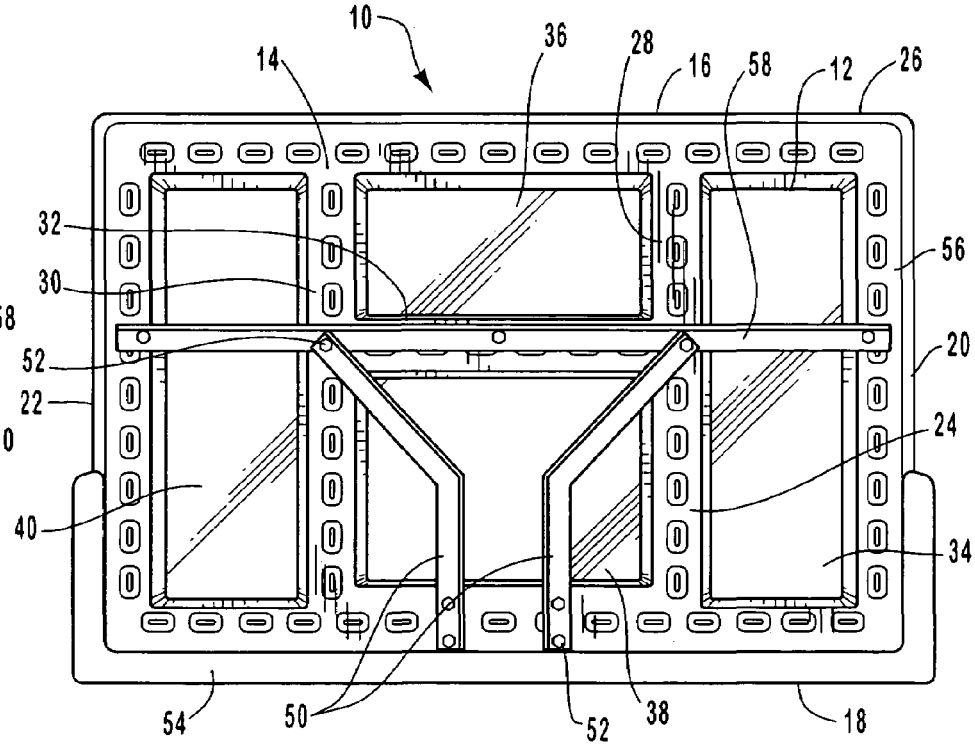
FIG. 5 is a rear view of the basketball goal assembly shown in FIG. 4.

The reinforcement structure may have other suitable shapes and sizes depending, for example, upon the size and configuration of the backboard 10 or the intended use of the basketball goal assembly 8. For example, as seen in FIGS. 4-6, the reinforcement structure 58 may include an elongated bar that is attached to the backboard 10 by any suitable fasteners, such as screws and or bolts, or other materials such glue or tape. In particular, the reinforcement structure 58 may include an elongated body that extends generally from the left side 20 to the right side 22 of the backboard 10 and the reinforcement structure may be sized and configured to increase the rigidity of the backboard.

The reinforcement structure 58 is preferably constructed from a relatively rigid, high-strength material such as metal or steel that generally does not easily bend or flex. As shown in the accompanying figures, the reinforcement structure 58 preferably has a generally L-shaped cross section, but it could have any suitable cross section such as a U or I-shaped cross section. The reinforcement structure 58 is desirably configured to minimize flexing or bending of the backboard 10 in order to increase the rebounding performance of the backboard. As shown in the accompany figures, the reinforcement structure 58 may extends horizontally from one edge of the backboard 10 to an opposing edge of the backboard. It will be appreciated, however, that the reinforcement structure 58 may have other suitable configurations, be attached to any suitable portion of backboard 10, and constructed from any materials with suitable characteristics.

Figure 7:
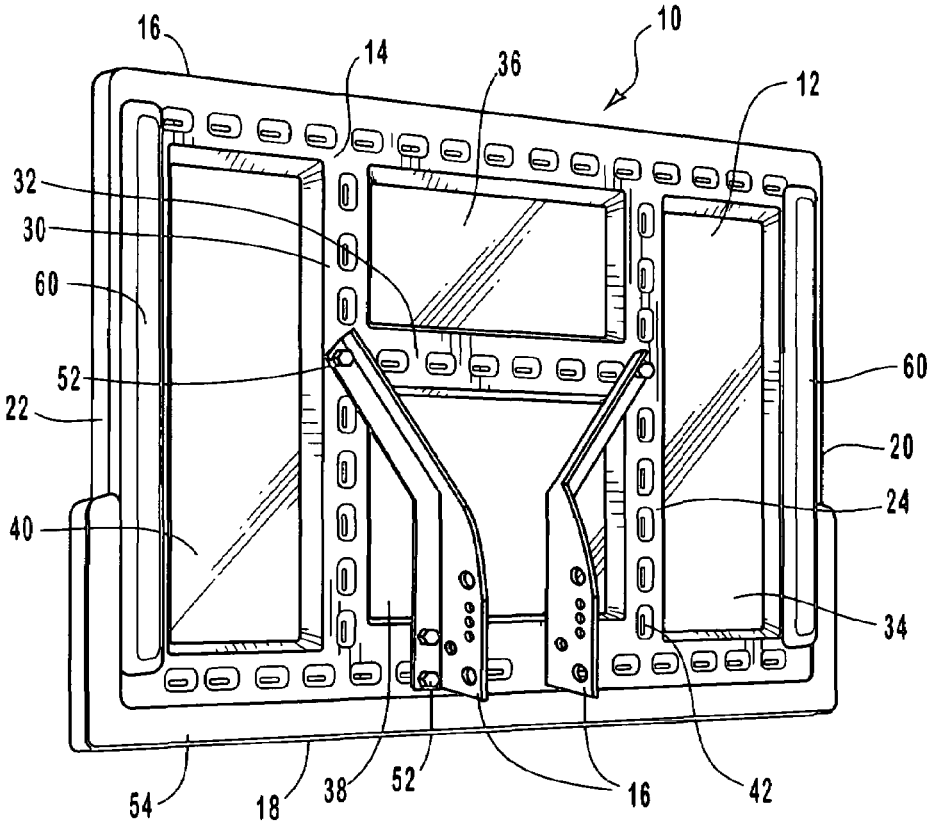
FIG. 7 is a rear perspective view of a basketball goal assembly in accordance with yet another embodiment of the invention.
Figure 8:
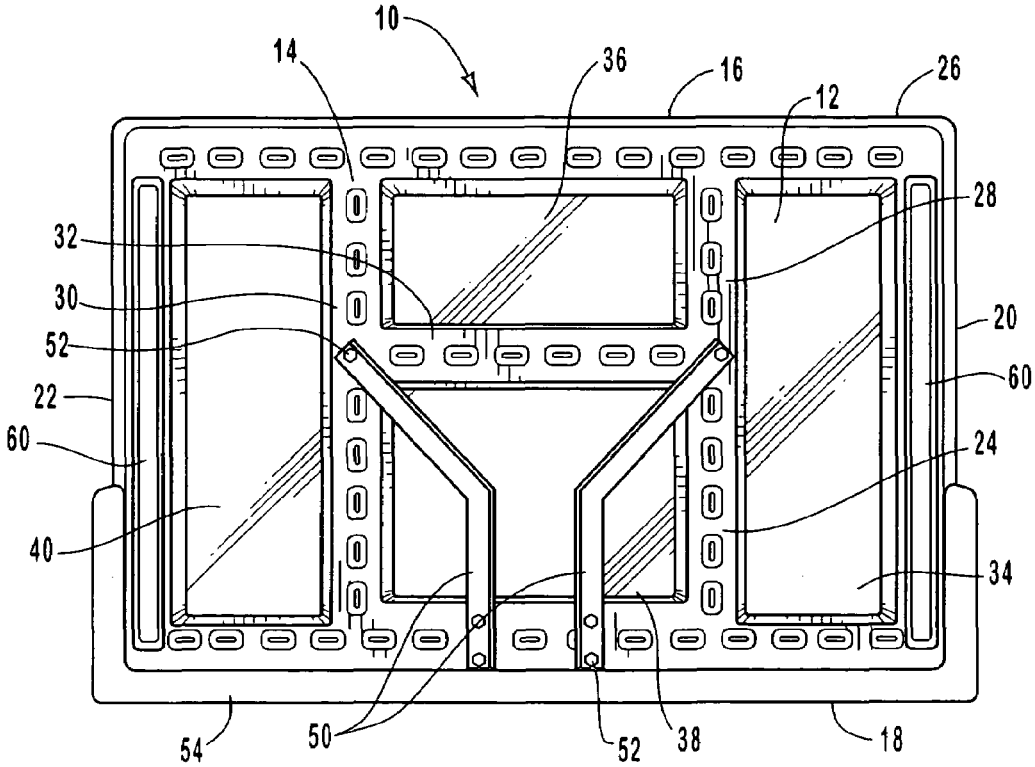
FIG. 8 is a rear view of the basketball goal assembly shown in FIG. 7.

As shown in FIGS. 7 and 8, one or more masses or weights 60 may be attached to selected portions of the backboard 10. The weights 60 are preferably attached proximate the outer edges or periphery of the backboard 10 and, in particular, to the left and right sides of the backboard. Positioning the weights 60 at or near the edges of the backboard 10 may help create a perimeter-weighted backboard. As discussed above, the added weights 60 may help prevent the backboard 10 from undesirably moving or deflecting when struck by the basketball, which provides for more consistent rebounding of the basketball. In addition, the weights 60 may be attached to portions of the backboard 10 that are disposed away from the support structure to help improve rebounding characteristics. It will be appreciated that the weights 60 can also be positioned in any desired locations and the weights can be divided into any suitable number depending, for example, upon the desired characteristics of the backboard 10.

The weights 60 can advantageously be attached to the backboard 10 after shipping and transportation of the basketball goal assembly 8, which may decrease costs. In addition, if the weights 60 are attached to the backboard 10 after the basketball goal assembly 8 is assembled, then that may make assembly of a basketball system easier for the consumer or retailer. The weights 60, however, can also be attached to the backboard 10 at any suitable time, including before, during or after the manufacturing process.

The weights 60 may be attached to or positioned within internal portions of the backboard 10. For example, the backboard 10 may include one or more openings that are sized and configured to be filled with materials such as water or sand. Thus, the backboard 10 may include one or more containers that are sized and configured to hold a predetermined quantity of water or sand. The containers may include a lid or top to prevent the water or sand from escaping. It will be appreciated that any suitable type of material may be used to create the weights 60, including pieces of metal, rocks, or other weight bearing items.

Advantageously, the weights 60 may also be sized and configured to increase the rigidity or strength of the backboard 10. For example, the weights 60 may consist of generally rigid materials that are not easily bent or curved. In particular, the weights 60 may consist of elongated metal rods or bars that are positioned proximate the outer edges of the backboard 10. The metal rods may be constructed from steel or other generally inflexible materials to increase the stiffness of the backboard 10. While the weights 60 are desirably positioned about the perimeter of the backboard 10, all or a portion of the weights 60 may be positioned proximate the center or other portions of the backboard.

As shown in FIGS. 9-11, another exemplary embodiment of the backboard 100 consists of a unitary, one-piece structure. Preferably, the one-piece backboard 100 is constructed from blow-molded plastic to form a lightweight structure but one skilled in the art will appreciate that the backboard could be constructed from any suitable type of plastic and it could be formed by any suitable process such as injection molding, extrusion molding, compression molding, and the like. Further, the backboard 100 could be constructed from other suitable materials, such as metal, wood, acrylic, Lexan®, composites, and the like, with desirable characteristics. One skilled in the art will also appreciate that the backboard 100 may be constructed from any suitable combination of components that have the desired characteristics and size.

The backboard 100 may also include one or more weights 102 that are attached to or integrally formed with the backboard. As shown in FIG. 9, a first weight 102*a* is preferably attached to one side of the backboard 100 and a second weight 102*b* is attached to the other side of the backboard. The weights 102*a*, 102*b* are preferably attached to the outer edges or perimeter of the backboard 100 to create a generally perimeter-weighted backboard. It will be appreciated that the weights 102*a*, 102*b* could be attached to any suitable portions of the backboard 100 depending, for example, upon the intended use of the backboard.

The weights 102*a*, 102*b* are preferably attached to an external portion of the backboard 100 and at least a portion of the weights are preferably exposed. This allows the weights 102*a*, 102*b* to form part of the design or appearance of the backboard 100. Because at least a portion of the weights 102*a*, 102*b* are exposed, these portions of the weights are preferably finished. For example, the weights may be powder-coated, painted or otherwise finished.

As best seen in FIG. 11, the weights 102*a*, 102*b* may have a generally U-shaped cross sectional configuration and the weights may be connected to the outer edges of the backboard 100 by a snap, friction or interference fit. For example, the backboard 100 may include a groove 104 on the front surface 106 of the backboard 100 and a groove 108 on the rear surface 110 of the backboard. The weights 102*a*, 102*b* may include a first protrusion 112 that is sized and configured to be inserted into the groove 104 on the front surface 106 of the backboard 100 and a second protrusion 114 that is sized and configured to be inserted into the groove 108 on the rear surface 110 of the backboard. Advantageously, because the weights 102*a*, 102*b* may be connected to the backboard 100 by a snap, friction or interference fit, fasteners such as screws or bolts do not have to be used. This may expedite the manufacturing process and it may allow consumers or retailers to quickly and easily attach the weights 102*a*, 102*b* to the backboard 100. One skilled in the art will appreciate that fasteners, adhesives, and the like may also be used to connect the weights 102*a*, 102*b* to the backboard 100.

The weights 102*a*, 102*b* may also be attached to the backboard 100 by sliding the first and second protrusions 112, 114 into the grooves 104, 108. For example, the grooves 104, 108 may be positioned near opposing edges of the backboard 100 and the grooves may extend to the top of the backboard. The weights 102*a*, 102*b* can then be positioned so that the protrusions 112, 114 slide into the grooves 104, 108 to attach the weights to the backboard 100. Advantageously, this may allow the weights 102*a*, 102*b* to be quickly and easily attached to the backboard 100 by the manufacturer, retailer or consumer. Fasteners, adhesives and the like may then be used to secure the weights 102*a*, 102*b* to the backboard 100, if desired.

The weights 102*a*, 102*b* could also have other suitable configurations and arrangements. For example, the weights 102*a*, 102*b* could simply consist of elongated metal rods or bars that are attached to the backboard 100, or generally L-shaped channel members that are attached to one or more outer surfaces of the backboard. Accordingly, the weights 102*a*, 102*b* could have various suitable sizes and configurations depending, for example, upon the shape and intended use of the backboard 100.

The weights 102*a*, 102*b* are preferably constructed from relatively heavy materials, such as metal, to add additional weight to selected portions of the backboard 100. The weights 102*a*, 102*b* are also preferably constructed from relatively rigid materials, such as metal, to increase the stiffness of the backboard. Desirably, the weights 102*a*, 102*b* are constructed from steel because it is relatively easy to manufacture and form into the desired shapes and sizes, but it will be appreciated that the weights may be constructed from any materials with suitable properties and characteristics such as wood, plastics, composites, and the like.

Significantly, the backboard 100 may be used with or without the weights 102*a*, 102*b*. For example, it may be desired to use the backboard 100 in some situations without the weights 102*a*, 102*b* being attached to the backboard. On the other hand, it may be desirable to use the backboard 100 with the weights 102*a*, 102*b* attached. Advantageously, because the weights 102*a*, 102*b* can be attached to an external portion of the backboard 100, this may allow the weights to be selectively attached to the backboard. For example, the weights 102*a*, 102*b* may be attached after the manufacturing process. On the other hand, the weights 102*a*, 102*b* may be sold as an accessory to the backboard 100. In addition, the weights 102*a*, 102*b* may be removably attached to the backboard 100, if desired.

Although the weights 102*a*, 102*b* are shown in the accompanying figures as being attached to the sides of the backboard 100, the weights could be attached to any other suitable portions of the backboard. For example, one or more weights 102*a*, 102*b* may be attached to the upper or lower surfaces of the backboard, or additional weights may be attached to the center or interior portions of the backboard. In addition, the backboard 100 could include weights attached to either or both interior or exterior portions of the backboard depending, for example, upon the intended use and/or rebounding characteristics of the backboard.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball goal assembly comprising:

a backboard that is sized and configured to be attached to a support structure, the backboard being at least partially constructed from blow-molded plastic, the backboard including a front portion, a rear portion and hollow interior portion formed during the blow-molding process;

a first weight that is separate and discrete from the backboard, the first weight being sized and configured to enhance rebounding characteristics of the backboard;

a first weight attachment portion on a first side of the backboard, the first weight attachment portion being sized and configured to allow the first weight to be attached to the backboard;

a second weight that is separate and discrete from the backboard, the second weight being sized and configured to enhance rebounding characteristics of the backboard;

a second weight attachment portion on a second side of the backboard, the second weight attachment portion being sized and configured to allow the second weight to be attached to the backboard; and a rim disposed proximate the front portion of the backboard, the rim being spaced apart from the first weight and the second weight;

wherein the first weight is spaced apart from the second weight on opposing portions of the backboard to help create a perimeter-weighted basketball goal assembly; and wherein the first weight and the second weight can be independently attached to the backboard; and wherein the first weight and the second weight can be independently separated from the backboard.

2. The basketball goal assembly as in claim 1, wherein the first weight is at least partially disposed within an interior portion of the backboard and wherein the second weight is at least partially disposed within an interior portion of the backboard.

3. The basketball goal assembly as in claim 1, wherein the first weight and the second weight are spaced apart from a support structure that is used to connect the basketball goal assembly to a support pole.

4. The basketball goal assembly as in claim 1, wherein the first weight and the second weight are part of the same structure.

5. The basketball goal assembly as in claim 1, wherein the first weight is sized and configured to be selectively positioned independent of the second weight; and wherein the second weight is sized and configured to be selectively positioned independent of the first weight.

6. A basketball backboard including a front portion, a rear portion, a right side, a left side, an upper portion and a lower portion, the basketball backboard comprising:

a first weight that is separate and discrete from the backboard, the first weight having an elongated length, the first weight being sized and configured to be attached to the backboard to enhance the rebounding characteristics of the backboard;

a first receiving portion at least partially defined by the backboard, the first receiving portion being sized and configured to allow attachment of the first weight to the backboard;

a second weight that is separate and discrete from the backboard, the second weight having an elongated length, the second weight being sized and configured to be attached to the backboard to enhance rebounding characteristics of the backboard; and a second receiving portion at least partially defined by the backboard, the second receiving portion being sized and configured to allow attachment of the second weight to the backboard;

wherein the first weight is independent of other portions of the backboard;

wherein the second weight is independent of other portions of the backboard; and wherein the first weight is spaced apart from the second weight in opposing sections of the backboard to help create a perimeter-weighted basketball goal assembly; and wherein the first weight and the second weight can be independently attached to the backboard; and wherein the first weight and the second weight can be independently separated from the backboard.

7. The basketball backboard as in claim 6, wherein the first weight is at least partially disposed within an interior portion of the backboard and wherein the second weight is at least partially disposed within an interior portion of the backboard.

8. The basketball backboard as in claim 6, wherein the first weight and the second weight are spaced apart from a support structure that is used to connect to the basketball backboard to a support pole.

9. The basketball backboard as in claim 6, wherein the first weight and the second weight are part of the same structure.

10. The basketball backboard as in claim 6, wherein the first weight is sized and configured to be selectively positioned independent of the second weight; and wherein the second weight is sized and configured to be selectively positioned independent of the first weight.

11. The basketball backboard as in claim 6, wherein the first weight is spaced apart from the second weight on opposing portions of the backboard to facilitate a perimeter-weighted basketball backboard.

12. The basketball backboard as in claim 6, further comprising a rim attached to the basketball backboard, the first weight and the second weight being spaced apart from the rim.

13. The basketball backboard as in claim 6, wherein the first weight and the second weight are attached to an interior portion of the backboard.

14. The basketball backboard as in claim 6, wherein the first weight and the second weight are attached to an exterior portion of the backboard.

15. The basketball backboard as in claim 6, wherein at least a portion of the first weight and at least a portion of the second weight are sized and configured to increase the rigidity of the backboard.

16. The basketball backboard as in claim 6, wherein at least a portion of the first weight and at least a portion of the second weight are sized and configured to reinforce at least a portion of the backboard.

17. The basketball backboard as in claim 6, further comprising a support frame attached to the basketball backboard, the first weight and the second weight being spaced apart from the support frame.

18. The basketball backboard as in claim 6, wherein the basketball backboard is constructed from blow-molded plastic and includes a hollow interior portion that is formed during the blow-molding process.

19. A method of constructing a basketball backboard as in claims 1 or 6, the method comprising:

providing a backboard that is sized and configured to be attached to a support structure, the backboard being at least partially constructed from blow-molded plastic, the backboard including a front portion, a rear portion and hollow interior portion formed during the blow-molding process; providing a first weight attachment portion on a first side of the backboard, the first weight attachment portion being sized and configured to allow the first weight to be attached to the backboard; disposing a first weight in the first weight attachment portion, the first weight being separate and discrete from the backboard, the first weight being sized and configured to enhance rebounding characteristics of the backboard; providing a second weight attachment portion on a second side of the backboard, the second weight attachment portion being sized and configured to allow the second weight to be attached to the backboard; disposing a second weight in the second weight attachment portion, the second weight being separate and discrete from the backboard, the second weight being sized and configured to enhance rebounding characteristics of the backboard; and disposing a rim proximate the front portion of the backboard, the rim being spaced apart from the first weight and the second weight; wherein the first weight is spaced apart from the second weight on opposing portions of the backboard to help create a perimeter-weighted basketball goal assembly; wherein the first weight and the second weight can be independently attached to the backboard; and wherein the first weight and the second weight can be independently separated from the backboard.

20. The method as in claim 19, wherein the first weight is at least partially disposed within an interior portion of the backboard and wherein the second weight is at least partially disposed within an interior portion of the backboard.

21. The method as in claim 19, wherein the first weight and the second weight are spaced apart from a support structure that is used to connect the basketball goal assembly to a support pole.

22. The method as in claim 19, wherein the first weight is sized and configured to be selectively positioned independent of the second weight; and wherein the second weight is sized and configured to be selectively positioned independent of the first weight.

* * * * *

UNITED STATES PATENT AND TRADEMARK OFFICE

CERTIFICATE OF CORRECTION

PATENT NO. : 7,419,445 B2
APPLICATION NO. : 11/441470
DATED : September 2, 2008
INVENTOR(S) : Nye et al.

It is certified that error appears in the above-identified patent and that said Letters Patent is hereby corrected as shown below:

The title page, showing an illustrative figure, should be deleted and substitute therefor the attached title page Drawings
Sheet 1, Please replace the current drawings of Figures 1 and 2 with the following figures in which the "goal assembly 8" is depicted Column 1
Line 21, change "is well" to --is a well--
Line 60, change "different" to --at different--

Column 2
Line 45, change "be used" to --to be used--

Column 5
Line 46, change "such" to --such as--

Column 6
Line 5, change "have touch" to --have to touch--
Line 28, change "and that" to --which--

Column 7
Line 24, change "is" to --is a--

Column 8
Line 27, remove "1"
Line 31, change "10" to --100--

Column 10
Line 45, change "have" to --have to--
Line 64, change "any" to --by any--

UNITED STATES PATENT AND TRADEMARK OFFICE

CERTIFICATE OF CORRECTION

PATENT NO. : 7,419,445 B2
APPLICATION NO. : 11/441470
DATED : September 2, 2008
INVENTOR(S) : Nye et al.

It is certified that error appears in the above-identified patent and that said Letters Patent is hereby corrected as shown below:

Column 11
Line 3, change "according to" to --upon--
Line 43, change "located" to --locating--

Column 12
Line 27, change "extends" to --extend--
Line 31, change "and" to --and be--

Column 13
Line 32, change "102" to --102a, 102b--

Signed and Sealed this

Sixth Day of October, 2009

David J. Kappos

David J. Kappos
*Director of the United States Patent and Trademark Office*

(12) United States Patent
Nye et al.

(10) Patent No.: US 7,419,445 B2
(45) **Date of Patent: *Sep. 2, 2008**

(54) BASKETBALL BACKBOARD

(75) Inventors: S. Curtis Nye, Clinton, UT (US); Robert A. Astle, Farmington, UT (US)

(73) Assignee: Lifetime Products, Inc., Clearfield, UT (US)

( * ) Notice: Subject to any disclaimer, the term of this patent is extended or adjusted under 35 U.S.C. 154(b) by 3 days.

This patent is subject to a terminal disclaimer.

(21) Appl. No.: 11/441,470

(22) Filed: May 26, 2006

(65) Prior Publication Data

US 2006/0264276 A1 Nov. 23, 2006

Related U.S. Application Data

(63) Continuation of application No. 10/722,664, filed on Nov. 25, 2003, now Pat. No. 7,052,418.

(60) Provisional application No. 60/429,258, filed on Nov. 26, 2002.

(51) Int. Cl.
*A63B 63/08* (2006.01)

(52) U.S. Cl. ..... 473/481; D21/703

(58) Field of Classification Search ..... 473/481, 473/482, 483, 484, 485; D21/703
See application file for complete search history.

(56) References Cited

U.S. PATENT DOCUMENTS

| | | | | |
|---|---|---|---|---|
| 3,233,897 | A | 2/1966 | Sheets | |
| 3,603,588 | A | 9/1971 | Ebstein | |
| 3,788,642 | A | 1/1974 | Matras et al. | |
| 3,964,743 | A | 6/1976 | Salsich, Sr. | |
| 4,285,518 | A | 8/1981 | Pearo | |
| 4,320,896 | A | 3/1982 | Engle et al. | |
| 4,372,555 | A | 2/1983 | Sorensen | |
| 4,424,968 | A | 1/1984 | Smith | |
| 4,478,415 | A | 10/1984 | Schaffer et al. | |
| 4,588,188 | A * | 5/1986 | Mahoney et al. | 473/481 |
| 4,826,162 | A | 5/1989 | Allen | |
| 5,120,054 | A | 6/1992 | Wetzel | |
| 5,346,207 | A | 9/1994 | Heinen | |
| 5,507,484 | A | 4/1996 | Van Nimwegen | |
| 5,597,158 | A | 1/1997 | Spikes | |
| 5,722,902 | A | 3/1998 | Dupree | |
| 5,827,136 | A | 10/1998 | Halter et al. | |
| 5,839,982 | A | 11/1998 | Hying et al. | |
| 5,916,047 | A | 6/1999 | Schickert et al. | |
| 5,980,400 | A | 11/1999 | Schickert | |
| 5,980,401 | A | 11/1999 | Erlewine | |
| 6,004,231 | A * | 12/1999 | Schickert et al. | 473/481 |

(Continued)

*Primary Examiner*—Gene Kim
*Assistant Examiner*—M Chambers
(74) *Attorney, Agent, or Firm*—Workman Nydegger

(57) ABSTRACT

A basketball backboard may include one or more weights disposed proximate the perimeter of the backboard in order to enhance the rebounding characteristics of the backboard. In particular, a first weight may be positioned proximate a first side of the backboard and a second weight may be positioned proximate a second side of the backboard in order to enhance the rebounding characteristics of the backboard. Advantageously, the weights may be positioned internally within the backboard or the weights may be positioned externally to the backboard. In addition, the weights may be selectively or permanently attached to the backboard, and the weights may also be sized and configured to increase the rigidity of the basketball backboard.

22 Claims, 5 Drawing Sheets

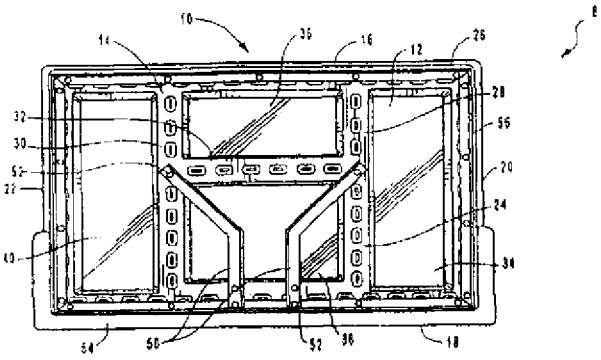

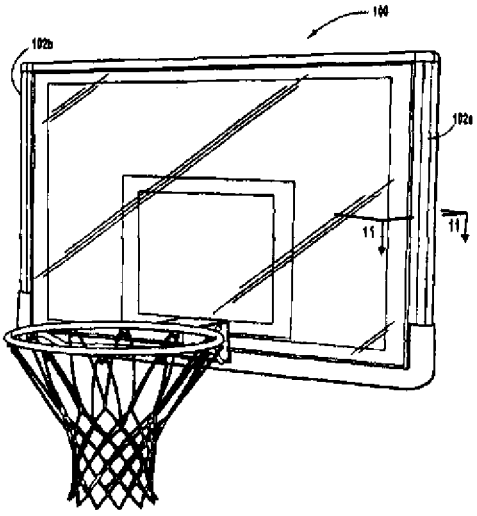

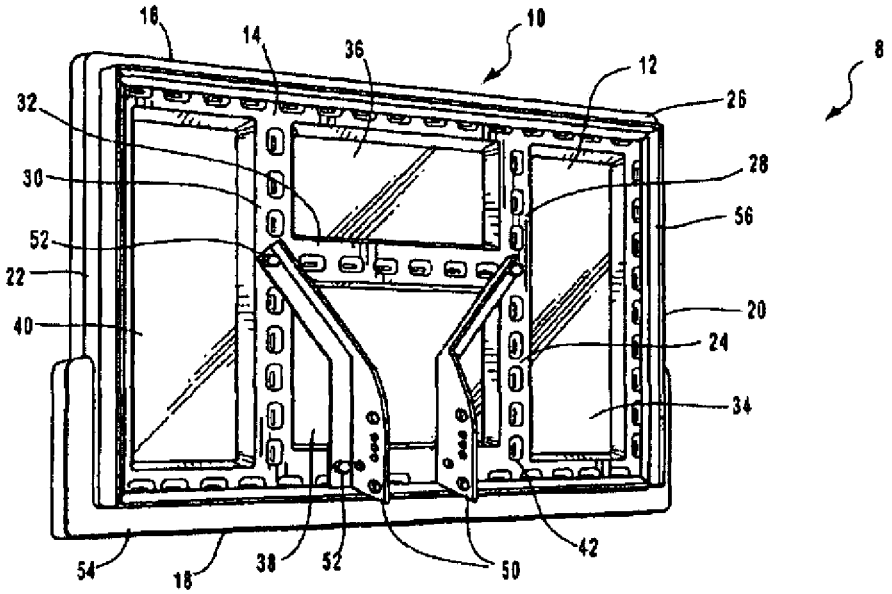
Fig. 1
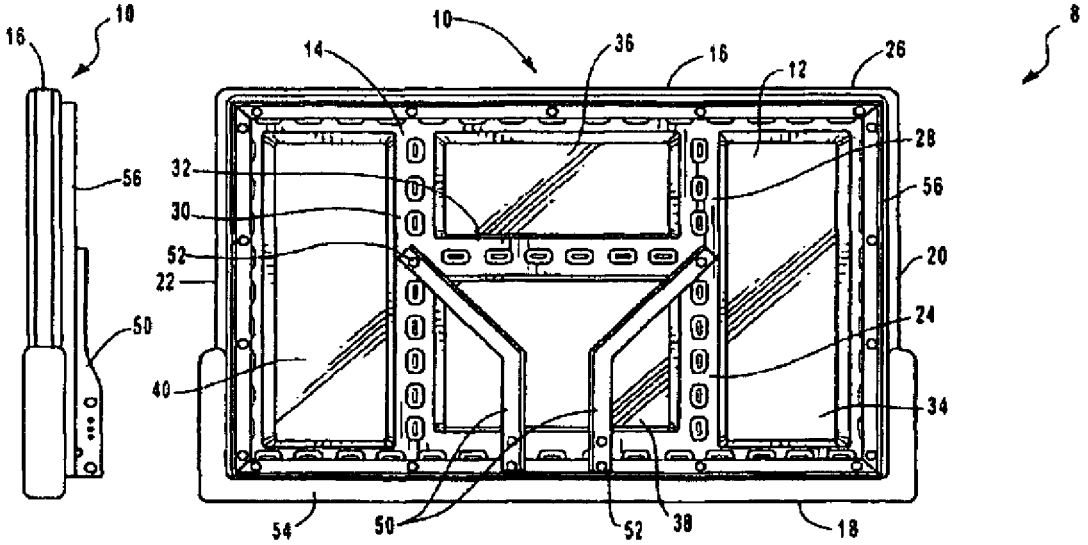
Fig. 3
Fig. 2